United States Patent [19]

Bissot

[11] Patent Number: 4,648,949

[45] Date of Patent: Mar. 10, 1987

[54] PROCESS FOR ELECTROLYSIS OF SILICA-CONTAINING BRINE

[75] Inventor: Thomas C. Bissot, Newark, Del.

[73] Assignee: E. I. Du Pont de Nemours and Company, Wilmington, Del.

[21] Appl. No.: 816,969

[22] Filed: Jan. 8, 1986

Related U.S. Application Data

[63] Continuation-in-part of Ser. No. 815,165, Dec. 31, 1985, abandoned.

[51] Int. Cl.[4] ..... C25B 1/16; C25B 1/26

[52] U.S. Cl. ..... 204/98; 204/128

[58] Field of Search ..... 204/98, 128, 296

[56] References Cited

U.S. PATENT DOCUMENTS

| | | | |
|---|---|---|---|
| 4,073,706 | 2/1978 | Nagy | 204/98 |
| 4,119,508 | 10/1978 | Yokota et al. | 204/128 |
| 4,155,820 | 5/1979 | Ogawa et al. | 204/98 |
| 4,176,022 | 11/1979 | Darlington | 204/98 |
| 4,178,218 | 12/1979 | Seko | 204/296 |
| 4,207,152 | 6/1980 | Kadija et al. | 204/98 |
| 4,261,803 | 4/1981 | Suhara et al. | 204/98 |
| 4,417,961 | 11/1983 | Ezzell et al. | 204/98 |
| 4,450,057 | 5/1984 | Kelly | 204/98 |
| 4,515,665 | 5/1985 | Fair et al. | 204/98 |
| 4,522,951 | 6/1985 | Lee et al. | 204/98 |
| 4,533,453 | 8/1985 | Oda et al. | 204/296 |

OTHER PUBLICATIONS

Research Disclosure, Jul. 1984, p. 348, Item 24337.

"Sulfate Ion Transport Through Perfluorinated Chloralkali Membranes: An Example of Co-Ion Fractionation in Membranes" by T. C. Bissot.

*Primary Examiner*—Terryence Chapman

[57] ABSTRACT

In an improved process for the electrolysis of silica-containing brine in a membrane cell, the thickness of the membrane, the concentration of silica, aluminum and calcium in the brine and the current density through the membrane in the operating cell are controlled to prevent silica damage to the membranes.

20 Claims, 1 Drawing Figure

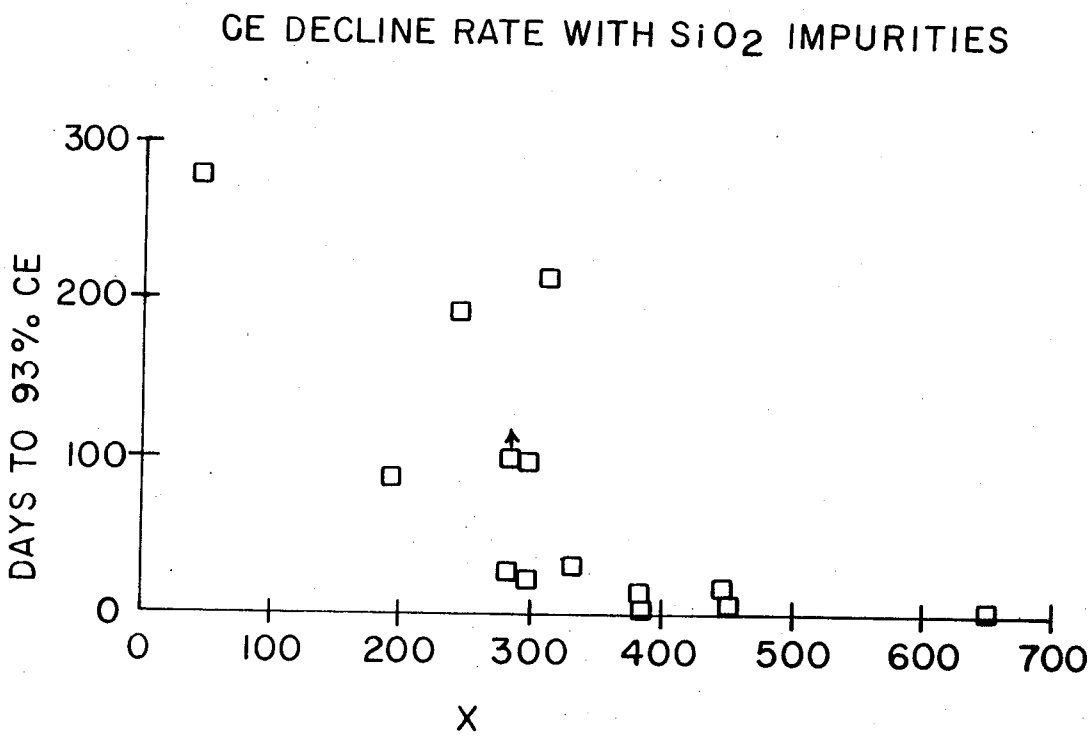
CE DECLINE RATE WITH SiO2 IMPURITIES
DAYS TO 93% CE
300
200
100
0
0
100
200
300
400
500
600
700
X

PROCESS FOR ELECTROLYSIS OF SILICA-CONTAINING BRINE

This application is a continuation-in-part of application Ser. No. 815,165 filed Dec. 31, 1985 now abandoned.

BACKGROUND

The use of perfluorinated ion-exchange membranes is rapidly expanding as the preferred energy-efficient technology for the electrolysis of brine to produce caustic and chlorine. Typical electrolytic cells used for this purpose comprise an anode and a cathode, an anode compartment and a cathode compartment, and the perfluorinated ion-exchange membrane situated so as to separate the two compartments. Brine is fed into the anode compartment, and a current is caused to flow through the cell.

It has been found that certain impurities in the brine feed can adversely affect the electrolysis process by reducing the performance and useful life of the ion-exchange membrane. One such common impurity in brine is silica ($SiO_2$). In the cell, silica can move through the membrane and precipitate as a complex with aluminum or calcium in the membrane layer adjacent to the catholyte. (Research Disclosure, July 1984, page 348, Item 24337, "Effect of Aluminum and Silica Impurities in Brine on Membrane Performance in Chloralkali Cells".)

To avoid membrane damage caused by silica, aluminum and calcium, prior practice has been to limit the concentrations of these cations in the brine feed to fixed levels. (This practice was not, however, apparently based on any recognition that silica could form membrane-damaging precipitates with calcium or aluminum). For example, U.S. Pat. No. 4,450,057, issued May 22, 1984, discloses a process for removing dissolved aluminum and silica contaminants from alkali metal halide brines involving contacting an acidified brine at a pH of between 2.0 and 3.0 with a strong macroreticular cationic chelating resin. U.S. Pat. No. 4,155,820, issued May 22, 1979, discloses a process for removing silica from aqueous sodium chloride solution by coprecipitation. The patent states that the amount of soluble silica in feed brine should be reduced to 4 ppm or less to avoid increases in electrolysis voltage. These practices, however, are not entirely satisfactory because they do not prevent membrane damage in all circumstances and often cause the cell operator added expense.

SUMMARY OF THE INVENTION

A method has now been found for reducing damage to ion-exchange membranes when brine containing silica and aluminum and/or calcium is electrolyzed in a membrane cell. It has been found that the transport rate of silica through a membrane increases with the concentration of silica in the feed brine, with the current density through the membrane and with the thickness of the membrane. It has also been found that membranes having gas- and liquid-permeable porous non-electrode coatings on the cathode-facing surface are more susceptible to damage by silica than membranes without such coatings. It has also been found that, although silica and aluminum were previously reported to combine to form precipitates in membranes, silica and calcium can also combine to form damaging precipitates. It has been further found that damage to membranes caused by silica precipitates can be minimized if the thickness of the membrane, T, the concentration of silica in the feed brine, Si, the concentration of aluminum in the feed brine, Al, the concentration of calcium in the feed brine, Ca, and the current density through the membrane, CD, are controlled so that the value of X in the following equation is, when a coated membrane is used, less than about 300 and, when an uncoated membrane is used, less than about 600:

$$\text{I. } X=[K(Si^{0.5})(CD^{0.75})(T^{0.5})][Al+3\ Ca]$$

where K is 0.0237 for coated membranes and 0.0305 for uncoated membranes, and where T is expressed in m, Si is expressed in ppm, Al and Ca are expressed in ppb and CD is expressed in $KA/m^2$. By using this process, one can avoid damage to ion-exchange membranes caused by silica precipitates without the necessity of maintaining unrealistically low concentrations of silica or aluminum or calcium in the brine feed to the membrane cell.

This process, based as it is on the finding that the transport rate of silica increases with both membrane thickness and current density, is surprising in view of known art. For example, J Pat. No. 56/33488, mentioned above, states that another ion, alkali metal sulfate, is transported through the membrane to the cathode side by diffusion. If this were the case with silica, one would expect silica transport to be minimized by increasing the thickness of the membrane, not by decreasing it as has now been found.

Other art which makes the present invention surprising relates to the transport of chloride ions through cation-exchange membranes. U.S. Pat. No. 4,276,130, issued on June 30, 1981, and assigned to Asahi Chemical, indicates that the transport of chloride ions through the membranes can be reduced by using a thicker membrane and higher current density. Yawataya, *Ion Exchange Membranes for Engineers,* Kyoritou Publishing Co., Ltd., Tokyo (1982), Section 8.7, also discloses that chloride transport is higher at low current density. These disclosures are, of course, just the opposite of what has now been found regarding silica: namely, that its transport rate increases with membrane thickness and current density.

BRIEF DESCRIPTION OF THE FIGURE

The FIGURE shows a plot of current efficiency versus impurity concentration.

DETAILED DESCRIPTION OF THE INVENTION

The cation exchange membranes used in this invention are known in the art and are prepared from perfluorinated polymers which have carboxylic acid and/or sulfonic acid functional groups. Perfluorinated polymers having carboxylic acid functional groups and from which cation exchange membranes can be prepared are disclosed in U.S. Pat. Nos. 3,852,326, 3,506,635, 4,267,364, 3,641,104, 4,178,218, 4,116,888, 4,065,366, 4,138,426, British Pat. Nos. 2,053,902A, 1,518,387 and U.S. Pat. No. 4,487,668. Perfluorinated polymers having sulfonic acid functional groups and from which cation-exchange membranes can be prepared are disclosed in U.S. Pat. Nos. 3,718,627, 3,282,875 and British Pat. No. 2,053,902A. In addition to preparing membranes from separate films of the above-identified polymers, it is possible to use a laminar film of two or more layers in making the membrane. The membrane may be unreinforced, but for dimensional stability and greater notched tear resistance, membranes are commonly reinforced with a material such as polytetrafluoroethylene or a copolymer of tetrafluoroethylene with perfluoro(-propyl vinyl ether).

The membranes used herein can be modified on either surface or both surfaces so as to have enchanced gas release properties, for example by providing optimum surface roughness or smoothness, or, preferably, by providing thereon a gas- and liquid-permeable porous non-electrode layer. Membranes having such a porous non-electrode layer on the cathode facing surface are herein termed "coated membranes"; membranes without such layers are herein termed "uncoated membranes". Such non-electrode layer can be in the form of a thin hydrophilic coating or spacer and is ordinarily of an inert electroinactive or non-electrocatalytic substance. Such non-electrode layer should have a porosity of 10 to 99%, preferably 30 to 70%, and an average pore diameter of 0.01 to 2000 microns, preferably 0.1 to 1000 microns, and a thickness generally in the range of 0.1 to 500 microns, preferably 1 to 300 microns. A non-electrode layer ordinarily comprises an inorganic component and a binder; the inorganic component can be of a type as set forth in published UK Patent Application GB No. 2,064,586A, preferably tin oxide, titanium oxide, zirconium oxide, or an iron oxide such as $Fe_2O_3$ or $Fe_3O_4$. Other information regarding non-electrode layers on ion-exchange membranes is found in published European Patent Application No. 0,031,660, and in Japanese Published Patent Application Nos. 56-108888 and 56-112487.

The binder component in a non-electrode layer can be, for example, polytetrafluoroethylene, a fluorocarbon polymer at least the surface of which is hydrophilic by virtue of treatment with ionizing radiation in air or a modifying agent to introduce functional groups such as —COOH or —$SO_3H$ (as described in published UK Patent Application GB No. 2,060,703A) or treatment with an agent such as sodium in liquid ammonia, a functionally substituted fluorocarbon polymer or copolymer which has carboxylate or sulfonate functional groups, or polytetrafluoroethylene particles modified on their surfaces with fluorinated copolymer having acid type functional groups (GB Pat. No. 2,064,586A). Such binder can be used in an amount of about from 10 to 50% by wt. of the non-electrode layer or of the electrocatalyst composition layer.

In Equation I, the variable T, the thickness of the membrane film, is by convention the thickness of the film in the melt processible state, i.e., before the carboxyl and sulfonyl side chains are hydrolyzed to the sodium or potassium salt form. If the membrane surface is to be modified, e.g., by roughening or by coating, T must be measured prior to such modification.

For fabric-reinforced membranes, corrections must be made to T and CD to correct for the thickness contributed by the fabric and the increase in actual current density caused by the shadowing of a portion of the membrane area by the fabric. To make this correction, the following calculations are performed:

Let a = decimal fraction open area of fabric and t = fabric thickness

T corrected = Film Thickness + t (1 − a)

CD corrected = CD measured ÷ a

The open area of fabric, a, can be measured in a number of ways. It is possible to make actual measurements and calculations from a magnified picture of the membrane. Alternatively, one can measure the light transmission through a membrane and calculate a by comparison with light transmission through a sample without fabric reinforcement.

Fabric thickness, t, is preferably measured on the fabric before the fabric is laminated with the polymer membrane. Alternatively, one can cut the membrane and microscopically measure the fabric thickness at the crossover point of two yarns. To gain the advantages of this invention, namely the ability to electrolyze brine solutions with high silica content, it is preferred to utilize relatively thin membranes, i.e., membranes for which T is in the range of about 50 to 200 m, preferably about 75 to 150 m.

The current density, CD, of a membrane is expressed in $kA/m^2$ of membrane active area. It is desirable, for reasons of economy, to operate a cell at the highest current density possible. Usually, this is in the range of about 1 to 6 $kA/m^2$. In order to electrolyze brine solutions with high silica content, it is preferred that the CD be in the range of about 1 to 3 $kA/m^2$.

It has been observed that the concentration of the brine has relatively little effect on silica-type damage compared with the effects of membrane thickness, silica concentration and current density. Thus, the process of this invention can be operated within a broad range of exit brine concentrations, e.g., about 100 to 220 g/l. For practical purposes, exit brine concentration will generally be within the range of 170–210 g/l.

The effect of caustic concentration on silica-type damage also appears to be minor in comparison with the factors cited above. Thus, the process of this invention is operable within a broad range of caustic concentrations, e.g., about 20–42% caustic. Typical caustic concentrations in commercial operations are about 32–35%.

The concentration of silica, aluminum and calcium in the feed brine can vary from negligible amounts (e.g., 0.1 ppm Si, 5 ppb Al and 10 ppb Ca) to as high as about 100 ppm Si, 1000 ppb Al and 2000 ppb Ca. Of course, the higher the concentration of silica, the lower the concentration of aluminum or calcium will have to be to fit Equation I. Since the advantage of this invention is that it enables one to use brine high in concentration of these ions, it is possible that brines having silica content of as high as 100 ppm or more, aluminum content of as high as 1000 ppb or more or calcium content of as high as 50 ppb or more can be successfully electrolyzed by appropriately controlling membrane thickness, current density and concentration of other ions. Calcium content is limited by the known effect of calcium hydroxide precipitation.

Amounts of silica and aluminum in brine can be determined colorimetrically using tests known in the art. The colorimetric method known as the Molybdenum Blue Method, AHPA "Standard Methods for the Examination of Water and Wastewater," 14th Ed., 490 (1975) can be used as the basis for a test for determining silica content. A method based on Eriochrome Cyanine R dye has been found to give excellent results for the quantitative determination of trace amounts of soluble aluminum in brine. The procedure is based on the method in AHPA "Standard Methods for the Examination of Water and Wastewater," 15th Ed. Methods for quantitatively determining trace quantities of calcium in brine are not as well known, and a procedure is suggested below.

Procedure for Analysis of Calcium in Brine

Trace quantities of calcium in the 0–200 ppb range can be measured colorimetrically using a conventional laboratory benchtop colorimeter. The method is based on an indicator such as Cal-Ver B® (Hach Chemical Company, Loveland Colo.). The dye, which has a blue color in brine, reacts with calcium to form a red color. By measuring both the absorbance change in the loss of the blue color (at 630 mm) and the increase in red color (500 mm) and adding the values, improved sensitivity is obtained. The sum of the absorbance changes is linear with calcium content to approximately 110 ppb but curves off slightly at higher values.

(i) REAGENTS

A. Stock Calcium Solution—Dissolve 0.25 grams of $CaCO_3$ in water containing 5 ml of high purity concentrated HCl or equivalent. Dilute to 1000 ml.

B. Working Calcium Solution—Pipette 10.0 ml of solution A into a 1-liter volumetric flask and dilute to the mark with purified brine. 1 ml=1.0 microgram $Ca^{++}$.

C. Indicator Solution for Hardness in Brine—(such as Hach Cat. No. 21932, Cal-Ver B®).

D. Buffer Solution/KOH—(such as Hach Cat. No. 21832).

E. EDTA Solution—Dissolve 3.79 g of disodium ethyleneaminetetraacetate in deionized water. Dilute to 1 liter with deionized water.

F. Purified brine (saturated), pH 7–10, containing 20 ppb $Ca^{++}$ or less.

(ii) CALIBRATION CURVE

1. Pipette 0.0, 0.9, 1.8, 3.0, 4.5, 6.0, 7.5 ml of Solution B into 50-ml volumetric flasks. Add purified brine to the mark in each flask and mix. This series corresponds to 0, 15, 30, 50, 75, 100 and 125 added ppb $Ca^{++}$, respectively.

2. Pipette 0.5 ml of Solution C (Indicator Solution) into each flask and mix.

3. Pipette 1.0 ml of Solution D (KOH Buffer Solution) into each flask and mix.

4. Divide 50-ml sample from flask by filling two matched 25-ml cells.

5. To one cell add 2 drops of Solution E (EDTA) and swirl to mix. Sample will turn from reddish purple to blue as red color due to calcium and magnesium are destroyed by the addition of EDTA. This cell is the BLANK. The other cell without the EDTA is the SAMPLE.

6.

(a) Place the SAMPLE cell in the cell holder of a spectrophotometer suitable for use at 500 nm and 630 nm wavelengths providing a light path of 2 cm or longer. Set the instrument to 630 nm wavelength and zero the instrument. Remove the SAMPLE cell and place the BLANK cell in the cell holder. Measure the absorbance of the BLANK and record as Absorbance 1.

(b) Leave the BLANK cell in the cell holder and set the instrument to 500 nm wavelength. Zero the instrument with the BLANK cell. Remove the BLANK cell and place the SAMPLE cell in the cell holder. Measure absorbance and record as Absorbance 2.

(c) Add Absorbance 1 plus Absorbance 2=Total Absorbance.

7. Plot curve for Total Absorbance of each standard versus ppb of $Ca^{++}$ added. Calcium content of purified brine can be read from calibration graph extending scale to the left of the y axis intercept per standard multiple standard addition method.

8. Relabel x axis for total $Ca^{++}$.

(iii) PROCEDURE FOR BRINE SAMPLE ANALYSIS FOR $Ca^{++}$

1. Check the pH of the brine sample to be analyzed. pH should be between 7–9 range. Adjust as required with pure NaOH or HCl solutions.

2. Transfer 50 ml of sample into a 25-ml Erlenmeyer flask.

3. Follow Steps (2) through (6) of Calibration Curve procedures.

4. Read ppb of $Ca^{++}$ from calibration curve using total $Ca^{++}$ scale.

In preferred embodiments of this invention, the variables T, CD, Si, Ca and Al are controlled so that X does not exceed about 250 in the case of coated membranes and X does not exceed about 400 in the case of uncoated membranes.

The following examples are offered to illustrate embodiments of this invention.

EXAMPLE 1

To illustrate the effects of membrane thickness, current density, and concentrations of silica, aluminum and calcium on the effectiveness of an ion-exchange membrane, series of tests were run in which the current efficiency of membranes subjected to different operating conditions were measured. Tests were made in lab cells of 45 $cm^2$ active area, operated at 90° C. with an anolyte of 200 gpl NaCl and catholyte at 32% NaOH. High purity ion exchanged brine, doped with $Na_2SiO_3.9H_2O$, $KAl[SO_4]_2.12H_2O$, and $CaCl_2.H_2O$, was used as cell feed. Membranes were experimental unreinforced and reinforced bilayer films having a thin layer of a carboxylic acid containing fluoropolymer joined to a thicker sulfonic acid containing copolymer. Membranes were cathode surface coated with non-conductive oxide particles for $H_2$ bubble release.

For purposes of comparison, a numerical value related to the rate of decline of the current efficiency (CE) obtained with a membrane, called "Days to 93% Current Efficiency", was calculated. Current efficiency performance was determined daily by weighing and titrating the caustic produced for a period of up to 30 to 50 days on line (DOL). The best straight line was fitted to the CE vs. DOL data points using standard lineal regression methods, and the intercept of this line with the 93% CE value yields the value "days to 93% CE". For membranes with a rapid decline rate, i.e. "days to 93% CE"=<20 DOL, the value is an accurate indicator of performance. For membranes with a very low rate of decline this value is only a rough indicator of predictable membrane life and tends to be very conservative since decay rates always appear higher in the first days or weeks of an experiment. In a few experiments the apparent CE appeared to be constant or actually increase with time. The "days to 93% CE" was assigned the value>100 in those cases. Data are presented in Table I and graphically in the FIGURE.

TABLE I

| | COATED MEMBRANES | | | | | | | |
|---|---|---|---|---|---|---|---|---|
| RUN | T (μm) | CD ($kA/m^2$) | CD corr. | Si (ppm) | Ca (ppb) | Al (ppb) | X | Days To 93% CE |
| 1 | 163 | 4.0 | 4.88 | 2.5 | 30 | 100 | 298 | 98 |

TABLE I-continued

| COATED MEMBRANES | | | | | | | | |
|---|---|---|---|---|---|---|---|---|
| RUN | T (μm) | CD (kA/m²) | CD corr. | Si (ppm) | Ca (ppb) | Al (ppb) | X | Days To 93% CE |
| 2 | 163 | 4.0 | 4.88 | 2.5 | 30 | 20 | 244 | 193 |
| 3 | 163 | 4.0 | 4.88 | 10.0 | 30 | 0 | 283 | 28 |
| 4 | 163 | 4.0 | 4.88 | 0.4 | 30 | 0 | 45 | 277 |
| 5 | 163 | 4.0 | 4.88 | 5.0 | 30 | 50 | 298 | 23 |
| 6 | 195 | 4.0 | 5.71 | 5.0 | 30 | 50 | 383 | 13 |
| 7 | 140 | 3.1 | 3.10 | 20.0 | 30 | 8 | 286 | 100 |
| 8 | 163 | 4.0 | 4.88 | 5.0 | 30 | 0 | 333 | 31 |
| 9 | 140 | 5.0 | 5.00 | 50.0 | 50 | 8 | 650 | 3 |
| 10 | 140 | 3.1 | 5.00 | 50.0 | 30 | 8 | 454 | 10 |
| 11 | 254 | 3.1 | 3.10 | 20.0 | 30 | 8 | 386 | 4 |
| 12 | 254 | 3.1 | 3.10 | 5.0 | 30 | 8 | 193 | 87 |
| 13 | 163 | 5.0 | 6.10 | 5.0 | 40 | 50 | 447 | 17 |
| 14 | 163 | 3.1 | 3.78 | 5.0 | 40 | 50 | 312 | 213 |

$CD_{corr}$ = CD corrected for fabric reinforced membranes
(T as shown is already corrected, where necessary)
X = as calculated per Equation I These data show a number of things. First, contrary to what had previously been disclosed in the art, (e.g., U.S. Pat. No. 4,155,820 which disclosed that soluble silica in brine should be reduced to 4 ppm or less), one can electrolyze brine with relatively high silica content under the conditions claimed and disclosed herein without seriously impairing the efficiency of the membrane. See, for example, Run #7 in which brine having 20 ppm silica was electrolyzed without seriously affecting current efficiency for at least one hundred days. The data also show that when conditions are such that X in Equation I exceeds about 300, Days to 93% CE rapidly diminish.

EXAMPLE 2

Using the same procedure set forth in Example 1, tests were run using uncoated membranes. Results are set forth in Table II.

TABLE II

| UNCOATED MEMBRANES | | | | | | | | |
|---|---|---|---|---|---|---|---|---|
| RUN | T (μm) | CD (kA/m²) | CD corr. | Si (ppm) | Ca (ppb) | Al (ppb) | X | Days To 93% CE |
| 1 | 163 | 4.0 | 4.88 | 5 | 30 | 100 | 543 | 290 |
| 2 | 163 | 4.0 | 4.88 | 5 | 50 | 100 | 715 | 27 |
| 3 | 195 | 4.0 | 5.71 | 10 | 30 | 8 | 488 | 60 |
| 4 | 163 | 4.0 | 4.88 | 10 | 30 | 8 | 395 | 100 |
| 5 | 195 | 4.0 | 5.71 | 5 | 30 | 50 | 491 | 16* |
| 6 | 195 | 4.0 | 5.71 | 5 | 30 | 20 | 386 | 50 |
| 7 | 195 | 4.0 | 5.71 | 2.5 | 30 | 20 | 274 | >100 |
| 8 | 195 | 4.0 | 5.71 | 2.5 | 30 | 50 | 349 | 138 |
| 9 | 195 | 4.0 | 5.71 | 2.5 | 30 | 100 | 473 | >100 |
| 10 | 195 | 4.0 | 5.71 | 2.5 | 30 | 20 | 274 | 47 |
| 11 | 163 | 4.0 | 4.88 | 5.0 | 30 | 50 | 399 | 138 |
| 12 | 163 | 4.0 | 4.88 | 5.0 | 30 | 50 | 399 | 171 |

*Contamination of brine suspected

What is claimed is:

1. In an improved process for the electrolysis of silica-containing brine in an electrolytic cell, said cell comprising a perfluorinated cation-exchange membrane situated so as to separate anode and cathode compartments, said membrane optionally coated on the cathode-facing surface with a gas- and liquid-permeable porous non-electrode coating; the improvement comprising controlling the thickness of the cation-exchange membrane, T, the concentration of silica in the brine feed, Si, the concentration of aluminum in the brine feed, Al, the concentration of calcium in the brine feed, Ca, and the current density through the membrane, CD, so that the value of X in the following equation is greater than zero and is less than about 300 when membranes having said porous non-electrode coating are used and is less than about 600 when membranes not having said porous non-electrode coating are used:

$$X=[K(Si^{0.5})(CD^{0.75})(T^{0.5})][Al+3\ Ca]$$

where K is 0.0237 when membranes having said porous non-electrode coating are used and is 0.0305 when membranes not having said porous non-electrode coating are used and where T is expressed in μm, Si is expressed in ppm, CD is expressed in kA/m² and Al and Ca are expressed in ppb.

2. A process of claim 1 where said membrane does not have said porous non-electrode coating.

3. A process of claim 2 where X is less than about 400.

4. A process of claim 2 where T is about 50 to 200 μm.

5. A process of claim 4 where T is about 75 to 150 μm.

6. A process of claim 2 where CD is about 1 to 3 kA/m².

7. A process of claim 2 where CD is about 1 to 3 kA/m².

8. A process of claim 2 where Si is at least about 10 ppm.

9. A process of claim 2 where Si is at least about 20 ppm.

10. A process of claim 1 where said membrane has said porous non-electrode coating.

11. A process of claim 10 where X is less than about 250.

12. A process of claim 10 where T is about 50 to 200 μm.

13. A process of claim 12 where T is about 75 to 150 μm.

14. A process of claim 10 where CD is about 1 to 3 $kA/m^2$.

15. A process of claim 10 where Si is at least about 10 ppm.

16. A process of claim 10 where Si is at least about 20 ppm.

17. A process of claim 1 where T is about 50 to 200 μm.

18. A process of claim 17 where T is about 75 to 150 μm.

19. A process of claim 1 where Si is at least about 10 ppm.

20. A process of claim 1 where Si is at least about 20 ppm.

* * * * *

UNITED STATES PATENT AND TRADEMARK OFFICE

CERTIFICATE OF CORRECTION

PATENT NO. : 4,648,949

DATED : March 10, 1987

INVENTOR(S) : Thomas C. Bissot

It is certified that error appears in the above—identified patent and that said Letters Patent is hereby corrected as shown below:

Claim 6, Column 8, Line 53, delete "Claim 2" and insert therefor --Claim 1--.

Signed and Sealed this

Eleventh Day of August, 1987

*Attest:*

DONALD J. QUIGG

*Attesting Officer*

*Commissioner of Patents and Trademarks*